US006023597A

United States Patent [19]

Mayuzumi et al.

[11] Patent Number: 6,023,597

[45] Date of Patent: Feb. 8, 2000

[54] CELLULAR CONDUCTIVE ROLLER WITH CONDUCTIVE POWDER FILLING OPEN CELLS IN THE SURFACE

[75] Inventors: Hiroshi Mayuzumi, Yokohama; Yoshiaki Nishimura, Tokyo; Jun Murata, Kawagoe; Nobutoshi Hayashi, Machida; Akiya Kume, Kawasaki; Yukinori Nagata, Yokohama, all of Japan

[73] Assignee: Canon Kabushiki Kaisha, Tokyo, Japan

[21] Appl. No.: 08/654,744

[22] Filed: May 29, 1996

[30] Foreign Application Priority Data

May 30, 1995 [JP] Japan ..... 7-131767

[51] Int. Cl.[7] ..... G03G 15/02

[52] U.S. Cl. ..... 399/176; 29/460; 428/36.5; 492/30

[58] Field of Search ..... 355/219; 361/225; 492/16, 30, 37, 53, 56; 399/283; 521/77; 29/460; 156/86, 187, 279; 427/419.2, 419.7; 428/36.8, 141, 164, 329, 158, 328

[56] References Cited

U.S. PATENT DOCUMENTS

| | | | |
|---|---|---|---|
| 3,807,853 | 4/1974 | Hudson | 399/357 |
| 4,010,308 | 3/1977 | Wiczer | 428/372 |
| 4,230,406 | 10/1980 | Klett | 399/353 |
| 4,464,428 | 8/1984 | Ebert et al. | 428/95 |
| 4,631,798 | 12/1986 | Ogino et al. | 29/460 |
| 4,788,570 | 11/1988 | Ogata et al. | 399/283 |
| 4,844,953 | 7/1989 | Kato et al. | 428/36.8 |
| 4,876,777 | 10/1989 | Chow | 29/460 |
| 5,241,343 | 8/1993 | Nishio | 355/219 |
| 5,309,007 | 5/1994 | Kugoh et al. | 355/219 |
| 5,353,102 | 10/1994 | Sato et al. | 399/176 |
| 5,443,873 | 8/1995 | Itani et al. | 428/36.5 |
| 5,482,978 | 1/1996 | Takahashi et al. | 521/82 |
| 5,529,842 | 6/1996 | Hoshizaki et al. | 428/329 |
| 5,587,774 | 12/1996 | Nagahara et al. | 399/259 X |
| 5,599,266 | 2/1997 | Landl et al. | 492/56 |
| 5,656,344 | 8/1997 | Sawa et al. | 428/36.5 |

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

A cellular conductive roller has closed cells and open cells with conductive powder filling the open cells of the cellular conductive roller. A method for making a cellular conductive roller includes filling the open cells in the cellular conductive roller with conductive powder, adhering a tacky sheet to the surface of said cellular conductive roller; then peeling said tacky sheet off the surface of said cellular conductive roller. Also disclosed is an electrophotographic device using the cellular conductive roller and a process cartridge into which the cellular conductive roller is integrated.

15 Claims, 2 Drawing Sheets

CELLULAR CONDUCTIVE ROLLER WITH CONDUCTIVE POWDER FILLING OPEN CELLS IN THE SURFACE

BACKGROUND OF THE INVENTION

1. Field of the Invention

The present invention relates to a cellular conductive roller used for charging, transferring, paper carriage, development, and cleaning in an image forming device using an electrophotographic process. The present invention further relates to a method for making the cellular conductive roller and an electrophotographic device using the same.

2. Description of the Related Art

Charging and discharging processes in electrophotographic processes have been carried out by using corona discharging. Ozone generated during corona discharging, however, promotes deterioration on the surface of the photosensitive member, and wire contamination, which results in some problems in image formation, such as image defects, black lines, and the like.

There has been intensive investigations on contact electrification and transferring methods to eliminate such disadvantages. Solid charging rollers made of conductive rubbers have been mainly used in the contact electrification methods, since some surface defects such as irregularity on the surface of the charging member cause a partially nonuniform charge. However, such solid rubber rollers have some problems such as charging noises because of the difficulty in the lowered roller hardness. On the other hand, the nip region, which is formed by the contact of the surfaces of the transferring roller and photoconductive drum in the transferring process, must be adjusted to an adequate hardness.

Therefore, cellular members containing dispersed conductive powder have been used as the conductive rollers instead of solid rubber rollers. Some cellular conductive rollers are made by inserting a tube made of a cellular rubber containing dispersed conductive powder into a mandrel, grinding the tube surface with an abrasive grind wheel, and removing grinds with air, a brush or the like. The resistance of the rollers made by such a process may be adjusted depending on its use by applying conductive paints on the surface.

When attempting to lower the hardness of the roller by changing the extent of foaming in the conventional cellular conductive rollers, the cell size of the cellular member must be increased. As a result, large cells appear on the surface of the roller after grinding, resulting in nonuniform contact with a photosensitive drum. Thus, such a method still retains a problem in that stable conductivity cannot be achieved.

Additionally, the conventional method set forth above has a following drawback especially in cleaning after grinding: Since cleaning by a compressed air blow or a brush after grinding is incomplete, the surface smoothness is lost on the surface of the cellular conductive roller, resulting in an unstable resistance in the area on which the roller comes in contact with a medium, a nonuniform surface smoothness and electrical resistance in spite of coating.

SUMMARY OF THE INVENTION

It is an object of the present invention to provide a cellular conductive roller having a smooth surface and uniform electrical resistance on the surface.

It is another object of the present invention to provide a method for making such a cellular conductive roller.

It is a further object of the present invention to provide an electrophotographic device using such a cellular conductive roller.

The cellular conductive roller in accordance with the present invention is characterized in that conductive powder fills the open cells in the surface of the cellular conductive roller.

In the cellular conductive roller in accordance with the present invention, since conductive powder fills the open cells in the surface of the cellular member, the surface of the cellular conductive roller is smoothed and exhibits electrical uniformity.

DETAILED DESCRIPTION OF THE PREFERRED EMBODIMENTS

The preferable embodiments in accordance with the present invention will now be explained with reference to the figures.

Figure 3:
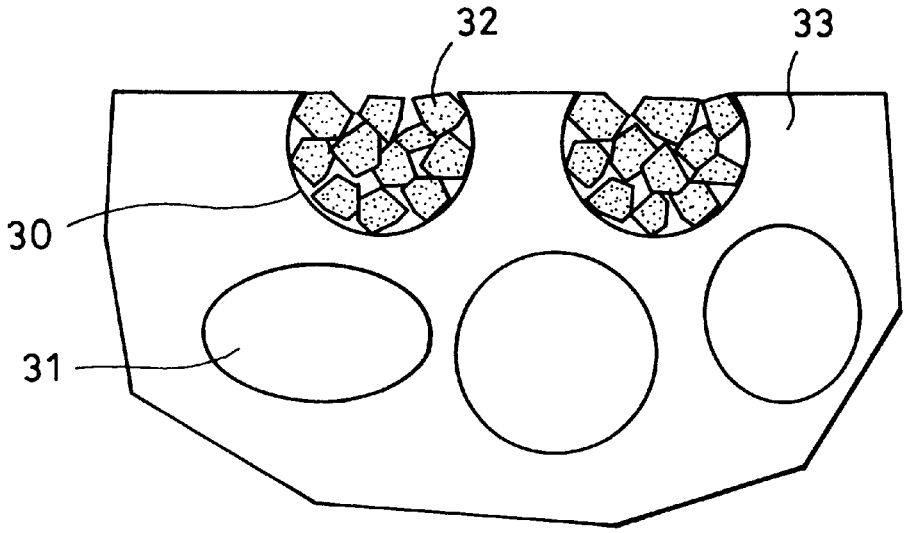
FIG. 3 is a schematic cross-sectional view illustrating that grinds fill the cells of the cellular member.

FIG. 3 is a schematic cross-sectional view illustrating the cellular conductive roller in accordance with the present invention. Open cells 30 in the roller surface of the cellular conductive roller 33 are filled with conductive powder 32, and closed cells 31 inside the roller are not filled with the conductive powder 32. The cellular conductive roller is formed by kneading a binding component, a conductive material, and a foaming agent, by shaping the kneaded mixture to a roller, then by curing while foaming the roller.

Examples of binder components may include natural rubbers and synthetic rubbers and plastics, such as butadiene polymers, isoprene polymers, butyl polymers, nitrile polymers, styrene-butadiene polymers, chloroprene polymers, acrylic polymers, ethylene-propylene polymers, urethane polymers, silicone polymers, fluoropolymers, and chlorine-containing polymers.

Examples of conductive materials may include carbonaceous materials, such as carbon blacks, and conductive carbon powders; metal powders; conductive fibers; semiconductive powders, such as metal oxide, e.g. tin oxide, zinc oxide, and titanium oxide; and mixtures thereof.

Examples of foaming agents may include various compounds. Between them, decomposable organic foaming agents are preferably used since the foaming sharply starts in the heating process and thus uniform cell size can be obtained.

Although the conductive materials set forth above also can be used as conductive powders filling the open cells in the surface of the cellular conductive roller, powders made by dispersing a conductive material in an elastic material are preferable since such materials do not decrease the elasticity of the cellular conductive roller. Further, it is preferred that the hardness of the conductive powder is the same as that of the non-cellular portion of the cellular conductive roller.

The preferable electric resistivity of the conductive powder ranges typically from $10^5$ to $10^9$ Ω·cm. The electric resistivity means a volume resistivity which is measured by applying 100 volts under a pressure of 500 g/cm$^2$ to a conductive powder filling an insulation cylindrical cell e.g. aluminum. To make both the cell portion and non-cellular portion the uniform resistivity, it is preferred that the conductive powders have substantially the same resistivity or composition as the cellular conductive roller.

Conductive elastic powders having a smaller particle size are preferably used to increase the filling rate. Such elastic powders may be made by dispersing a conductive material into an elastic material having a higher hardness.

The most preferable filling state of the conductive powder in the open cells is when the cell and non-cellular portions form a substantially even surface as shown in FIG. 3. However, it is preferable in general that the distance (A) from the top edge of the open cell at the roller surface to the bottom of the open cell is 50 $\mu$m or more when the open cell does not contain the conductive powder, and the distance (B) from the top edge at the roller surface to the top of the conductive powder filling the open cell is ½ or less of the distance (A), and more preferably, ⅓ or less.

When making the cellular conductive roller in accordance with the present invention, the conductive powder adhered to the non-cellular portion can be effectively removed by sticking and then peeling off a tacky sheet.

The cell size of the cellular conductive roller is preferably 500 $\mu$m or less considering the uniformity in the contact characteristics during charge, transfer, paper carriage, development and cleaning, or 200 $\mu$m or less to prevent the increase in irregularity when any surface coating is applied.

When a surface layer is coated on the surface of the cellular conductive roller after grinding and washing so as to obtain desirable electric characteristics, some residual grinds adhered to the roller surface often form protrusions due to grinds themselves or the contamination of the coating liquid by the grinds, resulting in unsatisfactory electric characteristics. Thus, it is preferred that the grinds adhered to the surface are removed. The electric resistivity of the surface layer is preferably $10^5$ to $10^9$ Ω·cm.

The methods for filling the open cells with the conductive powder may include placing a cellular conductive roller into a conductive powder and pressing the cellular conductive roller with another roller so as to squeeze the conductive powder into the open cells in the cellular conductive roller surface; electrically attracting a conductive powder into the open cells by means of a voltage applied to the cellular conductive roller; and squeezing grinds, which are formed during grinding the cellular conductive roller, into the open cells by means of the use of the grinds as the conductive powder. In the last method, the filling of the open cells with the grinds can be effectively achieved since the surface of the cellular conductive roller is activated by the grinding process.

A process for making a cellular conductive roller will be explained in which the roller surface is cleaned with a tacky sheet after grinding.

Figure 4:
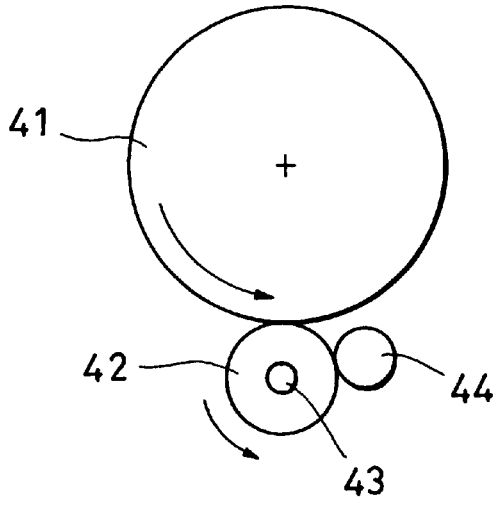
FIG. 4 is a schematic cross-sectional view illustrating a grinding machine in accordance with the present invention.

Such process can be carried out by using a device schematically shown in FIG. 4. The cellular conductive roller 42 is rotated adversely to a grinder 41 by a retaining roller 44 provided near the grinding position to squeeze the grinds formed at the grinding position and adhered to the surface of the cellular conductive roller 42 to fill the open cells of the cellular conductive roller 42 with the powder. The cellular conductive material of the cellular conductive roller 42 covers a mandrel 43.

Examples of materials for honing stones may include white alumina and green silicon carbide. These materials having different particle sizes can be used in combination. Honing stones having finer particle size are preferably used because the obtained grinds are sufficiently fine to fill effectively the open cells. At the roller surface which is obtained by the condition set forth above, it is observed that the grinds are filled or stuck in the open cells. Compressed air cleaning and brush cleaning removes not only the grinds stuck on the non-cellular position of the roller surface but also the grinds filling the open cells. Thus, the open cell size becomes larger than that before cleaning and the grinds stick again to the non-cellular portion of the roller surface, resulting in poor surface smoothness. Such poor surface smoothness causes fluctuation of the contact area of the roller with a medium and of the electric resistivity.

In contrast, at the surface of the cellular roller cleaned with a tacky sheet, only the grinds at the non-cellular portion of the roller surface can be removed because the tacky sheet can adhere to only protruded portions of the roller surface. Therefore, the grinds do not exist on the non-cellular portion of the roller surface while the grinds filling the open cells remain. The smooth surface of the cellular conductive roller attained by such a manner stabilizes electric resistivities of the roller before and after coating when the roller comes in contact with the medium.

Examples of tacky components of the tacky sheets may include urethane, natural rubber, epoxy, and acrylic compounds. Any tackiness of the tacky sheets can be selected according to demand as shown in JIS Z1528. An excessively low tackiness does not enable peeling off the adhered materials, whereas an excessively high tackiness will cause the rupture near the open cells. The tackiness preferably ranges from 600 g/20 mm-width to 1,800 g/20 mm-width.

Figure 1:
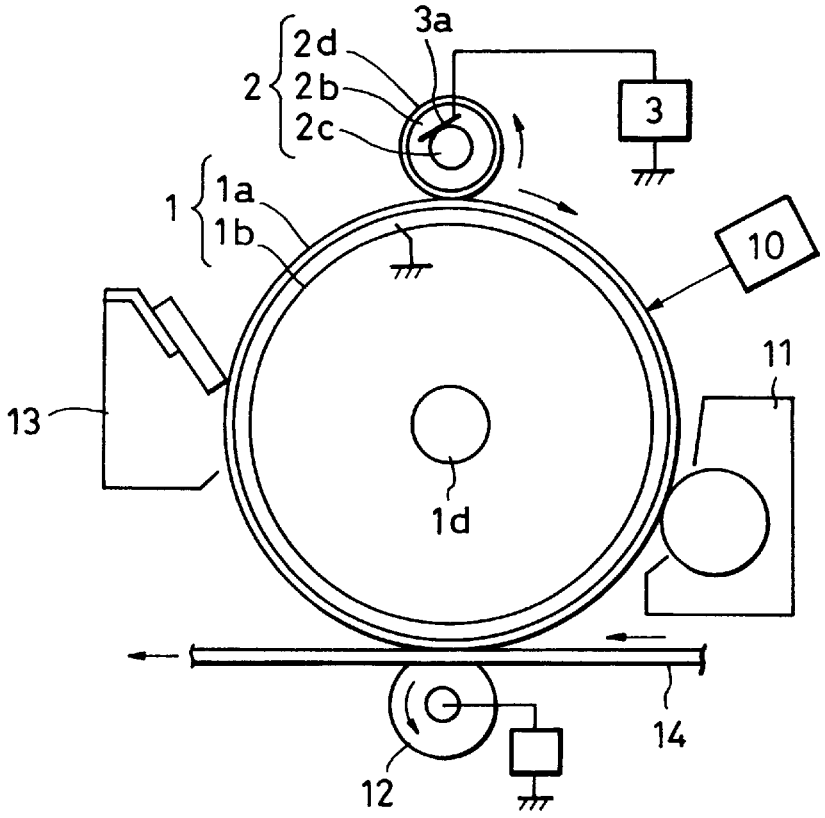
FIG. 1 is a schematic cross-sectional view illustrating an electrophotographic device using a contact charging and transferring member.

FIG. 1 is an embodiment of an electrophotographic device in which a cellular conductive roller is used as a contact electrification member. In this embodiment, a drum-type electrophotographic sensitive member 1 as a charged member, basically comprising a conductive supporting member 1*b* made of aluminum or the like and a photosensitive layer 1*a* formed thereon, rotates clockwise on a supporting shaft 1*d* at a given peripheral speed.

A roller-type electrification member 2 comes in contact with the surface of the photosensitive member 1 to primarily charge the surface to a given polarity and electric potential. The electrification member 2 comprises a mandrel 2*c*, a cellular conductive roller 2*b* formed thereon, and a surface layer 2*d* formed thereon. The electrification member 2, which is rotatably supported by bearing members (not shown in the figure) at both ends, is provided parallel to the drum-type photosensitive member so as to be pressed by a given pressing force onto the surface of the photosensitive member 1 with a pressing means (not shown in the figure), such as springs, and is rotated by the rotation of the photosensitive member 1. The mandrel 2*c* is biased with a predetermined DC or DC+AC voltage from an electric source so that the periphery of the rotatable photosensitive member 1 is subjected to the contact electrification at a predetermined polarity and electric potential.

The photosensitive member 1 homogeneously charged with the electrification member 2 is subjected to the exposure of given image information using a exposure means 10, such as a laser beam scanning exposure, and a slit exposure of an original image, so as to form an electrostatic latent image corresponding to the given image information on the periphery of the photosensitive member 1. The latent image is gradually visualized into a toner image using a developing means 11.

The toner image is gradually transferred to the surface of a transferring medium 14 which is fed by a transferring means 12 from a paper feeding means (not shown in the figure) to the transferring position between the photosensitive member 1 and transferring means 12 in synchronism with the rotation of the photosensitive member 1. In this embodiment, the transferring means 12 is a transferring roller which charges to a polarity adverse to that of the toner through the reverse side of the transferring medium 14 so that the toner image on the surface of the photosensitive member 1 is transferred to the front side of the transferring medium 14.

The transferring medium 14, after the toner image transfer, is released from the surface of the photosensitive member 1 and is fed to a fixing means (not shown in the figure) to fix the image for the final image output.

In the present invention, a plurality of elements, e.g. photosensitive member, electrification member, developing means, and cleaning means can be integrated in a process cartridge as shown in FIG. 1, so that the process cartridge can be loaded to and unloaded from the main body. For example, a cellular conductive roller in accordance with the present invention and at least one of a developing means and cleaning means if necessary are integrated with a photosensitive member in a process cartridge which is loaded into and unloaded from the main body by a guiding means e.g. rails.

The cellular conductive roller in accordance with the present invention can serve as transferring, primary electrification, de-electrification, and carriage rollers, such as paper-feeding rollers.

The cellular conductive roller in accordance with the present invention can be installed in electrophotographic devices, e.g. copying machines, laser beam printers, LED printers, and applied electrophotographic devices such as electrophotographic plate-making systems.

EXAMPLE 1

A charging roller was made by the following process: EPDM, Ketjen black, and an organic foaming agent were kneaded, and the rubber blend was extruded so as to make a tube and vulcanized while foaming. A mandrel was inserted into the tube to make a cellular charging roller having an average cell size of 100 $\mu$m and a resistance of $10^6$ $\Omega$. The cellular charging roller was ground while filling with the grinds using a grinder shown in FIG. 4. Results are shown in Table 1. Table 1 demonstrates that the cellular charging roller of EXAMPLE 1 has the most excellent characteristics as compared with other EXAMPLEs 2 and 3.

Figure 2:
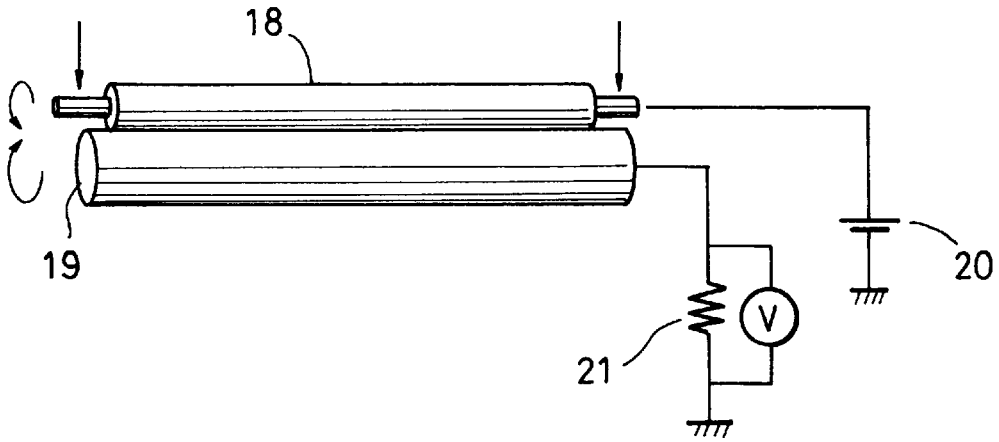
FIG. 2 is a schematic diagram illustrating a method for measuring the resistance of the cellular conductive roller.

The obtained roller was evaluated as below:

The resistance of the charging roller was measured using a method schematically shown in FIG. 2 to evaluate the irregularity of the resistance. The charging roller 18 is rotated while pressing on an aluminum drum 19, and 100 V of DC voltage is applied to the mandrel of the charging roller through an electric source 20. The circumferential fluctuation of the resistance of the charging roller was determined by the voltage applied to a resistance 21 connected in series with the aluminum drum 19. The average ratio of the maximum resistance (Max) to the minimum resistance (Min) was determined using ten rollers as shown in Table 1.

The surface smoothness was evaluated by microscopy, wherein the ratio of the area at which the grinds stick to the total area is used as a measure. A ratio of 10% or less is taken as "low ratio", a ratio of less than 30% and not less than 10% as "medium", and a ratio of 30% or more as "high ratio".

EXAMPLE 2

A charging roller made by a method identical to that of EXAMPLE 1 was ground with the grinder. After grinding, a roller having a smooth surface was pressed on the rotating cellular charging roller, while sprinkling the grinds so that the grinds are squeezed into the open cells in the charging roller surface.

The average ratio of the maximum resistance to the minimum resistance was determined using ten rollers as shown in Table 1.

EXAMPLE 3

A charging roller made by a method identical to that of EXAMPLE 1 was ground with the grinder. After grinding, a roller having a smooth surface was pressed on the rotating cellular charging roller, while sprinkling fine powders being composed of a Ketjen black-dispersed SBR, so that the fine powders are squeezed into the open cells in the charging roller surface.

The average ratio of the maximum resistance to the minimum resistance was determined using ten rollers as shown in Table 1.

COMPARATIVE EXAMPLE 1

A charging roller made by a method identical to that of EXAMPLE 1 was ground with the grinder, but without squeezing the grinds into the open cells. After grinding, the grinds on the cellular charging roller were removed by blowing air.

The average ratio of the maximum resistance to the minimum resistance was determined using ten rollers as shown in Table 1. The average ratio is greater than those in other EXAMPLEs.

In Table 1, the distance from the top edge of the open cell on the roller surface to the bottom of the open cell (hereinafter "distance A") was determined by the average of values at ten open cells selected at random from a cross-section of the roller. The distance from the top edge of the open cell at the roller surface to the top of the conductive powder filling the open cell (hereinafter "distance B") was determined by the following method: Three-dimensional shapes of ten open cells selected at random were measured using a laser microscope (1LM21 made by Lasertech) in a noncontacting mode, and the distance between the top of the grinds filling each open cell and ground surface was determined.

TABLE 1

| | EXAMPLE 1 | EXAMPLE 2 | EXAMPLE 3 | COMPARATIVE EXAMPLE 1 |
|---|---|---|---|---|
| Rubber Material | EPDM | EPDM | EPDM | EPDM |
| Conductive Material | Ketjen black | Ketjen black | Ketjen black | Ketjen black |
| Resistance | $10^6$ | $10^6$ | $10^6$ | $10^6$ |
| Conductive Powder | Filled | Filled | Filled | Not filled |
| Kind of Filled Powder | Abrasive powder | Abrasive powder | Pulverized rubber powder | None |
| Filling Method | While grinding | Pressing | Pressing | Not filled |
| Resistance Fluctuation (Max/Min) | 3.8 | 3.9 | 4.2 | 4.8 |
| Distance A | 60 | 60 | 60 | 60 |
| Distance B | 20 | 25 | 30 | — |

EXAMPLE 4

An EPDM blend in which a diazocarbonamide foaming agent and a conductive carbon were dispersed was extruded so as to form a tube with an extruder. A mandrel was inserted into the foamed tube after heating, then the foamed tube surface was ground with a honing stone WA320 at a rotation speed of 200 RPM and a feeding speed of 500 m/min. while filling with the grinds. The obtained foamed roller had a resistance of $10^6$ Ω and a cell size of 100 μmϕ. The foamed roller was cleaned with a tacky sheet having a peel-off tackiness of 550 g/20-mm width and a shearing adhesion of 5 kg/cm$^2$. The surface state was evaluated by microscopy and its electrical resistance. Results are shown in Table 2.

EXAMPLE 5

The foamed roller having a cell size of 100 μmϕ was evaluated by a method identical to EXAMPLE 4, except that a tacky sheet having a peel-off tackiness of 600 g/20-mm width and a shearing adhesion of 5.2 kg/cm$^2$ was used instead of the tacky sheet having a peel-off tackiness of 550 g/20-mm width and a shearing adhesion of 5 kg/cm$^2$. The surface state was evaluated by microscopy and its electrical resistance. Results are shown in Table 2.

EXAMPLE 6

The foamed roller having a cell size of 100 μmϕ was evaluated by a method identical to EXAMPLE 4, except that a tacky sheet having a peel-off tackiness of 1,800 g/20-mm width and a shearing adhesion of 7.6 kg/cm$^2$ was used instead of the tacky sheet having a peel-off tackiness of 550 g/20-mm width and a shearing adhesion of 5 kg/cm$^2$. The surface state was evaluated by microscopy and its electrical resistance. Results are shown in Table 2.

EXAMPLE 7

The foamed roller was evaluated by a method identical to EXAMPLE 4, except that a tacky sheet having a peel-off tackiness of 2,000 g/20-mm width and a shearing adhesion of 15 kg/cm$^2$ was used instead of the tacky sheet having a peel-off tackiness of 550 g/20-mm width and a shearing adhesion of 5 kg/cm$^2$. The surface state was evaluated by microscopy and its electrical resistance. Results are shown in Table 2.

COMPARATIVE EXAMPLE 2

The foamed roller was evaluated by a method identical to EXAMPLE 4, except that the foamed roller was cleaned by blowing a compressed air. The surface state was evaluated by microscopy and its electrical resistance. Results are shown in Table 2.

COMPARATIVE EXAMPLE 3

The foamed roller was evaluated by a method identical to EXAMPLE 4, except that the foamed roller was cleaned with a brush. The surface state was evaluated by microscopy and its electrical resistance. Results are shown in Table 2.

EXAMPLE 8

To the surface of the foamed roller prepared by the condition of EXAMPLE 4, a tin oxide coating dispersed into an aqueous urethane resin solution was applied so that the volume resistivity of the cellular conductive roller became $10^8$ Ω·cm. The resistance of the roller after coating was $10^6$ Ω. The surface state was evaluated by microscopy and its electrical resistance. Results are shown in Table 3.

EXAMPLE 9

To the surface of the foamed roller prepared by the condition of EXAMPLE 5, a tin oxide coating dispersed into an aqueous urethane resin solution was applied so that the volume resistivity of the cellular conductive roller became $10^8$ Ω·cm. The resistance of the roller after coating was $10^6$ Ω. The surface state was evaluated by microscopy and its electrical resistance. Results are shown in Table 3.

EXAMPLE 10

To the surface of the foamed roller prepared by the condition of EXAMPLE 6, a tin oxide coating dispersed into an aqueous urethane resin solution was applied so that the volume resistivity of the cellular conductive roller became $10^8$ Ω·cm. The resistance of the roller after coating was $10^6$ Ω. The surface state was evaluated by microscopy and its electrical resistance. Results are shown in Table 3.

EXAMPLE 11

To the surface of the foamed roller prepared by the condition of EXAMPLE 7, a tin oxide coating dispersed into an aqueous urethane resin solution was applied so that the volume resistivity of the cellular conductive roller became $10^8$ Ω·cm. The resistance of the roller after coating was $10^6$ Ω. The surface state was evaluated by microscopy and its electrical resistance. Results are shown in Table 3.

COMPARATIVE EXAMPLE 4

To the surface of the foamed roller prepared by the condition of COMPARATIVE EXAMPLE 2, a tin oxide coating dispersed into an aqueous urethane resin solution was applied so that the volume resistivity of the cellular conductive roller became $10^8$ Ω·cm. The resistance of the roller after coating was $10^6$ Ω. The surface state was evaluated by microscopy and its electrical resistance. Results are shown in Table 3.

COMPARATIVE EXAMPLE 5

To the surface of the foamed roller prepared by the condition of COMPARATIVE EXAMPLE 3, a tin oxide coating dispersed into an aqueous urethane resin solution was applied so that the volume resistivity of the cellular conductive roller became $10^8$ Ω·cm. The resistance of the roller after coating was $10^6$ Ω. The surface state was evaluated by microscopy and its electrical resistance. Results are shown in Table 3.

TABLE 2

| | Peeling Tackiness | Shearing Adhesion | Peeling of Abrasive Powder: Surface Layer (Ratio) | Peeling of Abrasive Powder: Open Cells (Ratio) | Resistance: Fluctuation (Max/Min) | Distance A (μm) | Distance B (μm) |
|---|---|---|---|---|---|---|---|
| EXAMPLE 4 | 550 g | 5 kg | Medium | Low | 2.3 | 60 | 20 |
| EXAMPLE 5 | 600 g | 5.2 kg | High | Low | 1.8 | 60 | 20 |
| EXAMPLE 6 | 1,800 g | 7.6 kg | High | Medium | 1.5 | 60 | 20 |
| EXAMPLE 7 | 2,000 g | 15 kg | High | High | 2.4 | 60 | 20 |
| COMP. EXAMPLE 2 | (Air cleaning) | | Medium | Low | 3.1 | 60 | 35 |
| COMP. EXAMPLE 3 | (Brush cleaning) | | Medium | Medium | 3.3 | 60 | 35 |
| EXAMPLE 1 | | | Low | Low | 3.8 | 60 | 20 |

TABLE 3

| | Peeling Tackiness | Shearing Adhesion | Surface Observation: Pinhole Occurrence | Surface Observation: Abrasive Powder Sticking Rate | Resistance: Fluctuation (Max/Min) |
|---|---|---|---|---|---|
| EXAMPLE 8 | 550 g | 5 kg | 5 | 26 | 1.7 |
| EXAMPLE 9 | 600 g | 5.2 kg | 6 | 5 | 1.5 |
| EXAMPLE 10 | 1,800 g | 7.6 kg | 10 | 3 | 1.4 |
| EXAMPLE 11 | 2,000 g | 15 kg | 22 | 2 | 1.8 |
| COMPARATIVE EXAMPLE 4 | (Air cleaning) | | 5 | 44 | 2.5 |
| COMPARATIVE EXAMPLE 5 | (Brush cleaning) | | 18 | 30 | 2.8 |

Table 2 demonstrates that cleaning with a tacky sheet results in excellent appearance and improved resistivity fluctuation.

Table 3 also demonstrates that cleaning with a tacky sheet results in excellent appearance and improved resistivity fluctuation.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cellular conductive roller having closed cells and open cells, the open cells being in the surface of the roller, and having conductive powder disposed in the open cells, and not disposed on a non-cellular portion in the surface of the roller.

2. A cellular conductive roller according to claim 1, wherein an electrical resistance of said conductive powder is the same as that of said cellular conductive roller.

3. A cellular conductive roller according to claim 2, wherein said conductive powder has the same composition as said cellular conductive roller.

4. A cellular conductive roller according to claim 3, wherein said conductive powder consists of grinds formed by grinding said cellular conductive roller.

5. A cellular conductive roller according to claim 1, wherein said cellular conductive roller is a charging roller.

6. A cellular conductive roller according to claim 1, wherein said cellular conductive roller is a transferring roller.

7. A cellular conductive roller according to claim 1, wherein an electrical resistance of said conductive powder ranges from $10^5$ to $10^9$ Ω.

8. A cellular conductive roller according to claim 1, wherein a distance (A) from a top edge of an open cell at the roller surface to a bottom of the open cell is 50 μm or more when the open cell does not contain the conductive powder, and a distance (B) from the top edge of the open cell at the roller surface to a top of the conductive powder filling the open cell is ½ or less of the distance (A).

9. A cellular conductive roller according to claim 8, wherein said distance (B) is ⅓ or less of the distance (A).

10. A cellular conductive roller according to claim 1, wherein said cellular conductive roller further comprises a surface layer.

11. A cellular conductive roller according to claim 10, wherein an electrical resistance of said surface layer ranges from $10^5$ to $10^9$ Ω·cm.

12. An electrophotographic device comprising a charging roller and an electrophotographic photosensitive member, said charging roller being a cellular conductive roller, and said cellular conductive roller having closed cells and open cells, the open cells being in the surface of the roller, wherein conductive powder is disposed in the open cells, and not disposed on a non-cellular portion in the surface of the roller.

13. An electrophotographic device according to claim 12, wherein said cellular conductive roller further comprises a surface layer.

14. A process cartridge integrating an electrophotographic photosensitive member and a charging roller, and adapted for removably mounting to a main body of an image forming device wherein, said charging roller is a cellular conductive roller, and said cellular conductive roller has closed cells and open cells and conductive powder is disposed in the open cells, and not disposed on a non-cellular portion in the surface of the roller.

15. A process cartridge according to claim 14, wherein said cellular conductive roller further comprises a surface layer.

* * * * *

UNITED STATES PATENT AND TRADEMARK OFFICE

CERTIFICATE OF CORRECTION

PATENT NO. : 6,023,597

DATED : February 8, 2000

INVENTOR(S): HIROSHI MAYUZUMI, ET AL.

It is certified that error appears in the above-identified patent and that said Letters Patent is hereby corrected as shown below:

COLUMN 4:
Line 61, "a" should read --an--.

COLUMN 7:
Line 28, "resistance." should read --resistance determined.--;
Line 37, "resistance." should read --resistance determined.--;
Line 47, "resistance." should read --resistance determined.--;
Line 55, "resistance." should read --resistance determined.--; and
Line 62, "resistance." should read --resistance determined.--.

COLUMN 8:
Line 17, "resistance." should read --resistance determined.--;
Line 26, "resistance." should read --resistance determined.--;
Line 35, "resistance." should read --resistance determined.--;
Line 44, "resistance." should read --resistance determined.--;
Line 53, "resistance." should read --resistance determined.--; and
Line 62, "resistance." should read --resistance determined.--.

UNITED STATES PATENT AND TRADEMARK OFFICE

CERTIFICATE OF CORRECTION

PATENT NO. : 6,023,597

DATED : February 8, 2000

INVENTOR(S): HIROSHI MAYUZUMI, ET AL.

It is certified that error appears in the above-identified patent and that said Letters Patent is hereby corrected as shown below:

COLUMN 9:

Line 5, "resistance." should read --resistance determined.--.

Signed and Sealed this

Sixth Day of March, 2001

Nicholas P. Godici

*Attest:*

NICHOLAS P. GODICI

*Attesting Officer*

*Acting Director of the United States Patent and Trademark Office*